US009364957B2

(12) United States Patent
Lake

(10) Patent No.: US 9,364,957 B2
(45) Date of Patent: Jun. 14, 2016

(54) ADJUSTMENT SCREW FOR FOLDING KNIFE SAFETY DEVICES

(71) Applicant: Ronald W. Lake, Eugene, OR (US)

(72) Inventor: Ronald W. Lake, Eugene, OR (US)

( * ) Notice: Subject to any disclaimer, the term of this patent is extended or adjusted under 35 U.S.C. 154(b) by 14 days.

(21) Appl. No.: 13/986,806

(22) Filed: Jun. 6, 2013

(65) Prior Publication Data

US 2014/0360023 A1 Dec. 11, 2014

Related U.S. Application Data

(60) Provisional application No. 61/689,431, filed on Jun. 6, 2012.

(51) Int. Cl.
*B26B 1/04* (2006.01)

(52) U.S. Cl.
CPC ..... *B26B 1/044* (2013.01)

(58) Field of Classification Search
CPC ..... B26B 1/044; B26B 1/046
See application file for complete search history.

(56) References Cited

U.S. PATENT DOCUMENTS 7,293,360 B2 * 11/2007 Steigerwalt ..... B26B 1/02 30/159
7,305,768 B2 * 12/2007 Hinderer ..... B26B 1/044 30/155
7,437,822 B2 10/2008 Flagg et al.
7,854,067 B2 * 12/2010 Lake ..... B26B 1/044 30/159
8,042,276 B2 * 10/2011 Lerch ..... B26B 1/044 30/155
8,375,589 B2 2/2013 Bremer et al.
8,413,338 B2 4/2013 Freeman
8,640,346 B2 * 2/2014 Allen ..... B27B 9/02 30/376
8,863,394 B2 * 10/2014 Lo ..... B26B 1/044 30/155
8,966,768 B2 * 3/2015 Onion ..... B26B 1/02 30/155
9,149,940 B2 * 10/2015 Hao ..... B26B 1/046
2014/0360023 A1 * 12/2014 Lake ..... B26B 1/044 30/161

* cited by examiner

*Primary Examiner* — Hwei C Payer
(74) *Attorney, Agent, or Firm* — Teri G. Andrews Attorney at Law

(57) ABSTRACT

A folding knife has a handle portion and a safety liner with a spring biased portion that slides laterally lodging the end of the spring biased portion under the tang of the knife blade to hold the blade in a safe open position. An adjustment screw has an extended ball surface disposed in a sleeve extending through and attached to one side of the handle and the safety liner. A rotational safety has a safe on detent and a safe off detent for receiving the ball is disposed between the safety liner and the tang of the blade. The blade is secured in the open position by rotating the rotational safety to a safe on position, lodging a safety engagement end under an edge of the spring safety portion of the safety liner and lodging the ball surface into the safe on detent. The adjustment screw is adjusted by to maintain the safety of the knife over time.

7 Claims, 3 Drawing Sheets

ADJUSTMENT SCREW FOR FOLDING KNIFE SAFETY DEVICES

CROSS-REFERENCE TO RELATED APPLICATIONS

This application claims priority under 35 U.S.C. §119(e) to U.S. Provisional Application Ser. No. 61/689,431 entitled "Adjustment Screw for Folding Knife Safety Devices" filed on Jun. 6, 2012, the entire disclosure of which is herein incorporated by reference for all purposes.

FIELD OF THE INVENTION

This invention relates to folding knives and, more particularly, to safety devices on folding knives.

BACKGROUND

Folding knives typically include a handle and one or more blades pivotally attached to the handle, the blades having a compact closed position and an extended open position. A user opens the blade by grasping the blade or pushing a knob protruding from the blade in order to rotate the black into the open position. A folding knife may have a locking mechanism configured to lock the blade into one or both of the closed or open positions. A number of locking mechanisms are known. One such locking mechanism is the liner lock which has a spring portion that the user slides with his thumb to lodge the spring portion under the tang of the blade keeping the blade in the open position. To close the blade, a user slides the spring portion from under the tang of the blade and then rotates the blade to the closed position. However, over time the spring safety can become weak or the user may inadvertently slide the spring safety from under the tang of the blade allowing the blade to close during use leading to a cut to the user or poor functioning of the knife as a cutting tool.

As an added safety, some knives have a rotational safety that when rotated in the 'safe' position further secures the spring portion of the liner under the tang of the blade by sliding a safety engagement end under the spring portion. Until the rotational safety is rotated to the 'safe off' position, the user cannot inadvertently slide the spring safety free of the tang of the blade.

It is well-known that folding knives will loosen in the blade pivot area over time. A worn knife safety may become less functional and inadvertently dislodge the safety that is intended to maintain the position of the blade whether in the open or the closed position.

There is a need for a safety feature that is adjustable as the knife becomes worn and the safety features become less effective thereby compromising the safety and usefulness of the knife.

SUMMARY OF THE INVENTION

It is the principal object of the present invention to provide an adjustable safety feature for a folding knife that maintains the safety objectives of the knife even after extended use and wear.

The present invention is a folding knife with a handle portion having a safety liner with a spring biased safety portion that the user slides laterally to lodge the end of the spring biased safety portion under the tang of the knife blade to maintain the blade in a safe open position. An adjustment screw having an extended ball surface is disposed in a sleeve that extends through and is fixedly attached to one side of the handle and the safety liner of the folding knife. There is a rotational safety having a safe on detent and a safe off detent for receiving the extended ball surface of the adjustment screw disposed between the safety liner and the tang of the blade. The blade is further secured in the open position when the user rotates the rotational safety via a safety thumb switch to a safe on position, lodging a safety engagement end under an edge of the spring safety portion of the safety liner and lodging the ball surface into the safe on detent. The adjustment screw can be adjusted for more or less pressure on the rotational safety by the user screwing the adjustment screw into or out of the sleeve thereby maintaining the safety of the knife as the knife ages and wears.

BRIEF DESCRIPTION OF THE DRAWINGS

The above description and other objects, advantages, and features of the present invention will be more fully understood and appreciated by reference to the specification and accompanying drawings, wherein:

FIG. 4*a* shows the rotational safety in the 'safety off' position while FIG. 4*b* shows the rotational safety in the 'safety on' position.

Figure 1:
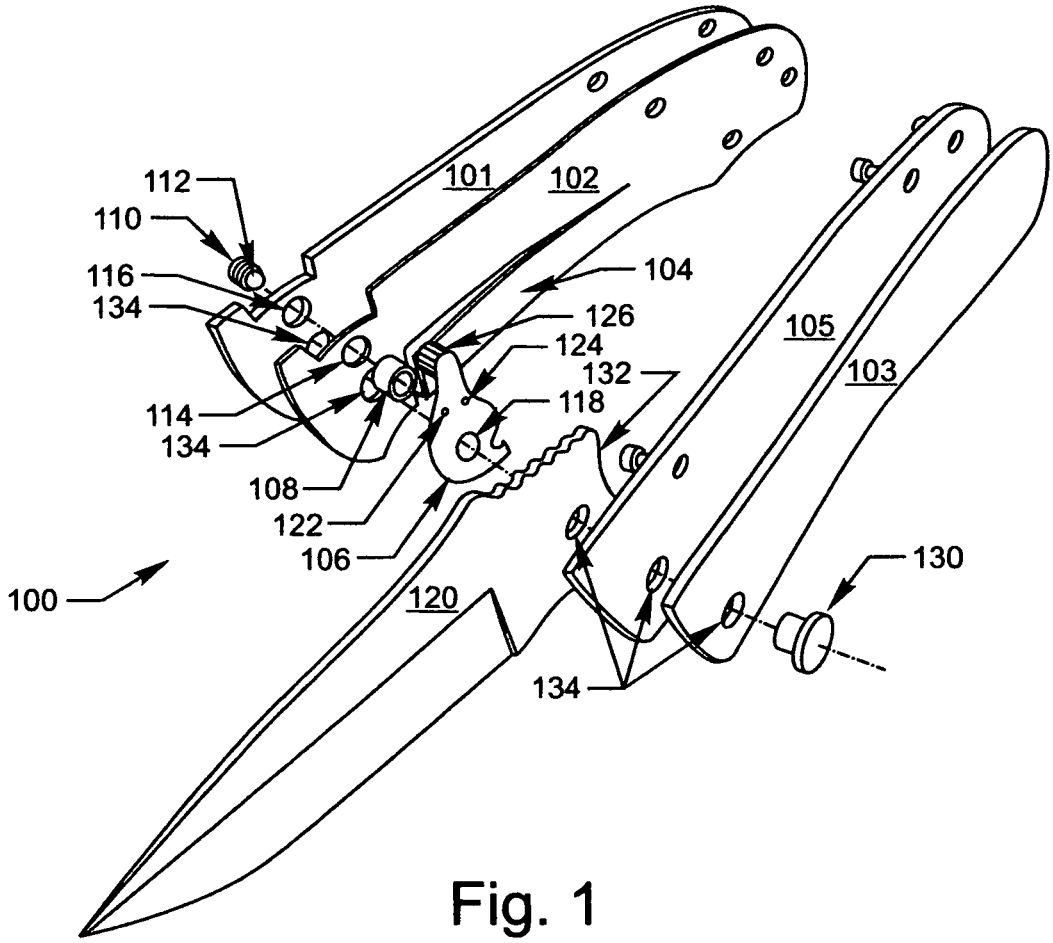
FIG. 1 is an exploded view of a folding knife depicting the placement of the rotational safety and the adjustment screw of the present invention.

| DRAWINGS - Reference Numerals | |
|---|---|
| 100 Folding Knife | 202 Internal Threads |
| 101 Handle Outer | 204 External Threads |
| 102 Safety Liner | 206 Adjustment Point |
| 103 Second Handle Outer | |
| 104 Spring Safety | |
| 105 Liner | |
| 106 Rotational Safety | 302 Alternate Adjustment Screw |
| 108 Sleeve | 304 Ball |
| 110 Adjustment Screw | 306 Cavity |
| 112 Ball Surface | |
| 114 Liner Hole | |
| 116 Outer Hole | |
| 118 Pivot Point | 402 Safety Engagement End |
| 120 Blade | 404 Safety Spring End |
| 122 Safe Off Detent | |
| 124 Safe Detent | |
| 126 Safety Thumb Switch | |
| 130 Assembly Screw | |
| 132 Tang | |
| 134 Assembly Holes | |

DETAILED DISCUSSION OF THE PREFERRED EMBODIMENTS

Referring to the figures, like elements retain their indicators throughout the several views.

FIG. 1 is an exploded view of Folding Knife 100 depicting the placement of Rotational Safety 106 and Adjustment Screw 110 of the present invention.

As shown in FIG. 1, Rotational Safety 106 is positioned between Safety Liner 102 and Blade 120. Assembly Screw 130 extends through Assembly Holes 134 disposed in Second Handle Outer 103, Liner 105, and Blade 120 approximate Tang 132, Pivot Point 118 of Rotational Safety 106, and Assembly Holes 134 disposed in Safety Liner 102, and Handle Outer 101 such that Blade 120 is housed between Liner 105 and Safety Liner 102 when in the closed position. Rotational Safety 106 has a Safe Off Detent 122 and a Safe On Detent 124.

Adjustment Screw 110 has a Ball Surface 112 and threads into Sleeve 108 which extends through Outer Hole 116 of Handle Outer 101 and Liner Hole 114 of Safety Liner 102. Sleeve 108 is secured in place by glue, epoxy, staking, pressing, or the like. Safety Thumb Switch 126 allows the user to oscillate Rotational Safety 106 between a 'safe off' position and a 'safe on' position by lodging Ball Surface 112 of Adjustment Screw 110 into either Safe Off Detent 122 when Blade 120 is closed or Safe On Detent 124 when Blade 120 is open.

Figure 2:
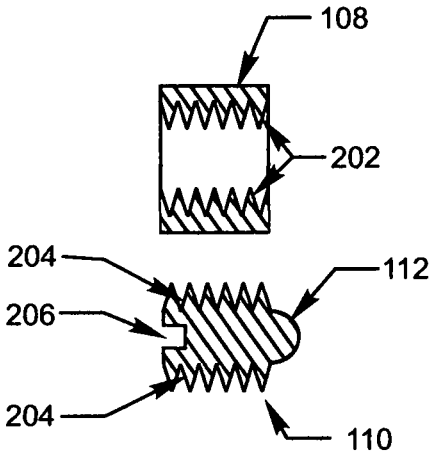
FIG. 2 is a cross-sectional view of the sleeve and adjustment screw of the present invention taken down the center and lengthwise of each.

FIG. 2 is a cross-sectional view of Sleeve 108 and Adjustment Screw 110 of the present invention taken down the center and lengthwise of each. As shown, Sleeve 108 is a cylinder with Internal Threads 202 that External Threads 204 of Adjustment Screw 110 screw into via Adjustment Point 206 allowing Ball Surface 112 to extend beyond Sleeve 108. In this embodiment, Ball Surface 112 is an integral part of Adjustment Screw 110. As Folding Knife 100 begins to wear and loosen over time, Adjustment Screw 110 is rotated inward extending Ball Surface 112 for the desired tension into the knife safety detent holes of Rotational Safety 106 (not shown).

Although Adjustment Point 206 appears to be a flat screw driver slot, any type of screw driver receptacle such as spline, star, hex, or the like, will work.

Figure 3:
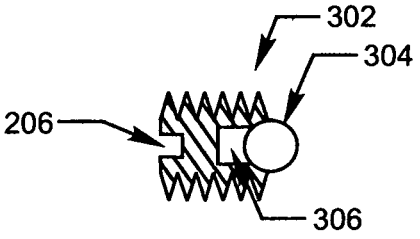
FIG. 3 is a cross-sectional view of an alternate adjustment screw of the present invention taken down the center and lengthwise.

FIG. 3 is a cross-sectional view of Alternate Adjustment Screw 302 of the present invention taken down the center and lengthwise. In this alternate embodiment, Alternate Adjustment Screw 302 has a Cavity 306 in the end opposite Adjustment Point 206 which Ball 304 is pressed or staked into. Ball 304 can be of any hard material such as steel or ceramic.

Figure 4A:
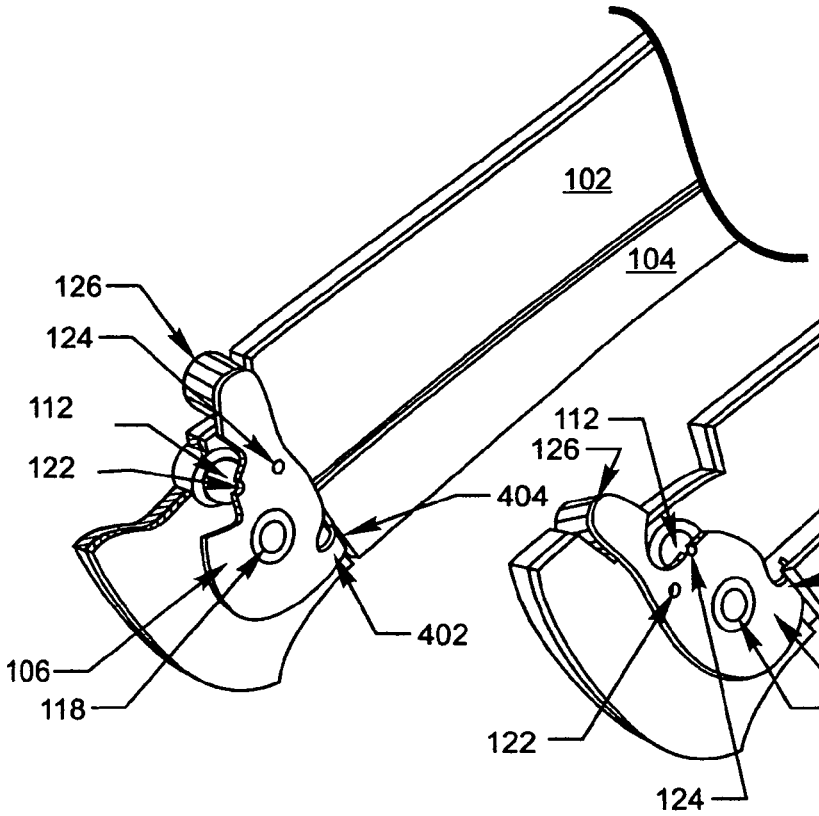
FIGS. 4*a* and 4*b* are cutaway views of the folding knife of FIG. 1 focusing on the rotational safety and the detail of the adjustment screw of the present invention.
Figure 4B:
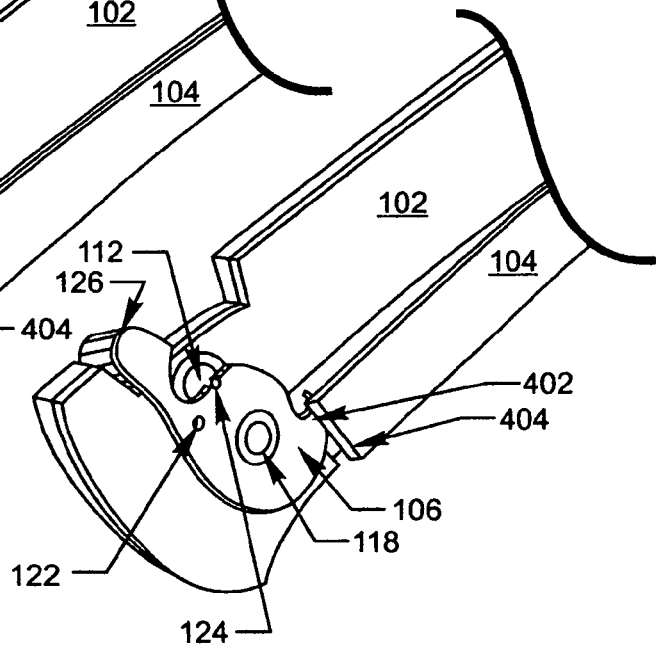

FIGS. 4*a* and 4*b* are cutaway views of Folding Knife 100 of FIG. 1 with cutaway views of Rotational Safety 106 detailing placement of Ball Surface 112 of Adjustment Screw 110 with respect to Safe Off Detent 122 and Safe On Detent 124. In FIG. 4*a*, Safety Thumb Switch 126 has rotated Rotational Safety 106 at Pivot Point 118 to the 'safe off' position. In 'safe off', Ball Surface 112 is lodged in Safe Off Detent 122 of Rotational Safety 106.

FIG. 4*b* shows Safety Thumb Switch 126 of Rotational Safety 106 in the 'safe on' position. In 'safe on', Spring Safety 104 is lodged under Tang 132 (not shown) and Safety Engagement End 402 of Rotational Safety 106 is lodged under an edge of Spring Safety 104 with Ball Surface 112 lodged in Safe Detent 124 for added safety. As previously discussed, as the pivot area of the knife blade loosens over time, Adjustment Screw 110 can be rotated thereby extended to increase the tension on Rotational Safety 106 and maintain the security of Safety Engagement End 402 under Safety Spring End 404.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. A folding knife, comprising:

a handle portion having a handle outer, a safety liner adjacent to the handle outer having a safety spring portion having a safety spring end, and a second liner adjacent to a second handle outer;

a blade have a tang portion that is pivotably coupled to the handle portion between the safety liner and the second liner of the handle portion and operable to pivot between a closed position and an open position;

a rotational safety pivotably coupled to the handle portion between the blade and the safety liner, the rotational safety having a safety thumb switch for rotating the rotational safety between a first position and a second position, a safe-off detent, a safe-on detent, and a safety engagement end; and an adjustment screw having a ball surface and rotatably disposed in a sleeve, the sleeve extending through and fixedly attached to the handle outer and the safety liner such that the ball surface contacts the rotational safety;

wherein, with the blade extended to the open position, the safety spring portion is moved laterally and lodged under the tang portion of the blade, the safety thumb switch is rotated to the first position lodging the ball surface of the adjustment screw into the safe-on detent of the rotational safety securing the safety engagement end under the safety spring portion of the safety liner thereby securing the blade in the open position, the blade is secured in the closed position by rotating the safety thumb switch to the second position thereby dislodging the ball surface from the safe-on detent, lodging the ball surface in the safe-off detent and the safety engagement end rotates from under the safety spring portion such that the safety spring portion is dislodged from under the tang portion allowing the blade to return to and securely maintain in the closed position, the adjustment screw can be rotated by a user to adjust pressure of the ball surface on the rotational safety.

2. The folding knife of claim 1, wherein the adjustment screw is steel.

3. The folding knife of claim 1, wherein the adjustment screw is ceramic.

4. The folding knife of claim 1, wherein the adjustment screw further comprises a cavity disposed in an end thereof, a ball having the ball surface, the ball lodged in the cavity such that the ball surface extends from the cavity.

5. A folding knife, comprising:

a handle portion having a handle outer, a safety liner adjacent to the handle outer having a safety spring portion having a safety spring end, and a second liner adjacent to a second handle outer;

a blade have a tang portion that is pivotably coupled to the handle portion between the safety liner and the second liner of the handle portion and operable to pivot between a closed position and an open position;

a rotational safety pivotably coupled to the handle portion between the blade and the safety liner, the rotational safety having a safety thumb switch for rotating the rotational safety between a first position and a second position, a safe-off detent, a safe-on detent, and a safety engagement end; and an adjustment screw having a cavity disposed in an end, a ball having a ball surface lodged in the cavity such that the ball surface extends from the cavity, the adjustment screw rotatably disposed in a sleeve, the sleeve extending through and fixedly attached to the handle outer and the safety liner such that the ball surface contacts the rotational safety;

wherein, with the blade extended to the open position, the safety spring portion is moved laterally and lodged under the tang portion of the blade, the safety thumb switch is rotated to the first position lodging the ball surface of the ball into the safe-on detent of the rotational safety securing the safety engagement end under the safety spring portion of the safety liner thereby securing the blade in the open position, the blade is secured in the closed position by rotating the safety thumb switch to the second position thereby dislodging the ball surface from the safe-on detent, lodging the ball surface in the safe-off detent and the safety engagement end rotates from under the safety spring portion such that the safety spring portion is dislodged from under the tang portion allowing the blade to return to and securely maintain in the closed position, the adjustment screw can be rotated by a user to adjust pressure of the ball surface on the rotational safety.

6. The folding knife of claim 5, wherein the ball is steel.

7. The folding knife of claim 5, wherein the ball is ceramic.

* * * * *